US010206457B2

(12) United States Patent
Dorosin

(10) Patent No.: US 10,206,457 B2
(45) Date of Patent: Feb. 19, 2019

(54) ONE-PIECE SHOE INSERT FOR PRESERVING AND RESTORING THE SHAPE OF POINTED TOE BOXES

(71) Applicant: Christine Marie Reicker Dorosin, Menlo Park, CA (US)

(72) Inventor: Christine Marie Reicker Dorosin, Menlo Park, CA (US)

( * ) Notice: Subject to any disclaimer, the term of this patent is extended or adjusted under 35 U.S.C. 154(b) by 0 days.

(21) Appl. No.: 14/631,792

(22) Filed: Feb. 25, 2015

(65) Prior Publication Data

US 2016/0242507 A1 Aug. 25, 2016

(51) Int. Cl.

| | |
|---|---|
| ***A43B 23/08*** | (2006.01) |
| ***A43B 7/14*** | (2006.01) |
| ***A43B 19/00*** | (2006.01) |

(52) U.S. Cl.

CPC ..... *A43B 23/081* (2013.01); *A43B 7/1465* (2013.01); *A43B 19/00* (2013.01); *A43B 23/087* (2013.01)

(58) Field of Classification Search

CPC ..... A43B 23/086; A43B 23/08; A43B 23/087
See application file for complete search history.

(56) References Cited

U.S. PATENT DOCUMENTS

| | | | | |
|---|---|---|---|---|
| 1,744,122 | A * | 1/1930 | Keeling | A43B 5/12 36/113 |
| 1,788,389 | A * | 1/1931 | Garrett | A43B 23/086 36/77 R |
| 4,155,180 | A * | 5/1979 | Phillips | A43B 5/06 36/103 |
| 4,554,694 | A | 11/1985 | Tradigo | |
| 5,129,165 | A * | 7/1992 | Woodle | A43B 5/12 36/8.3 |
| 5,791,069 | A * | 8/1998 | Oradesky | A43B 23/081 36/71 |
| 6,584,707 | B1 * | 7/2003 | Racine | A43B 3/26 36/112 |
| D498,915 | S | 11/2004 | Achcar | |
| 7,827,707 | B2 * | 11/2010 | Davis | A43B 3/26 36/71 |
| 2007/0234595 | A1 * | 10/2007 | Davis | A43B 3/26 36/94 |
| 2008/0141565 | A1 * | 6/2008 | Rini | A43B 23/087 36/77 R |

(Continued)

FOREIGN PATENT DOCUMENTS

| | | |
|---|---|---|
| GB | 0614276.4 | 6/2006 |

*Primary Examiner* — Megan E Lynch

(57) ABSTRACT

A one-piece, triangular shoe insert for use in pointed-toe shoes where the toe box extends beyond the tips of the toes. The insert is small enough to fit into a toe box of a pointed toe shoe and not cram the toes. The insert is large enough so that the insert remains in place within a pointed toe box due to friction. The insert is made of a dense but resilient material, so that it also remains in place within a toe box due to expansion of the material against the surface of the interior, curved underside of the toe box. The insert may remain in a shoe for the life of a shoe, or it may be removed by wedging one's index finger or a blunt object such as a flat-edge screwdriver underneath the insert and pulling it out. Upon removal from a shoe, the resilient material from which the one-piece insert is made springs back to its original shape, and the one-piece insert may be reused.

6 Claims, 4 Drawing Sheets

(56) References Cited

U.S. PATENT DOCUMENTS

| | | | | |
|---|---|---|---|---|
| 2009/0260263 | A1* | 10/2009 | Beard | A43B 23/087<br>36/72 R |
| 2010/0251568 | A1* | 10/2010 | Haruda | A43B 1/0045<br>36/43 |
| 2011/0010963 | A1* | 1/2011 | Webb | A43B 7/26<br>36/43 |
| 2011/0265348 | A1* | 11/2011 | Schmutte | A43B 5/12<br>36/93 |
| 2013/0117948 | A1* | 5/2013 | Dorosin | A43B 23/086<br>12/128 R |

* cited by examiner

ONE-PIECE SHOE INSERT FOR PRESERVING AND RESTORING THE SHAPE OF POINTED TOE BOXES

BACKGROUND

Field of Invention

This disclosure relates to apparel and more particularly to shoe inserts.

Prior Art

The following is a tabulation of some prior art that presently appears relevant:

U.S. Patents

| Pat. No. | Kind Code | Issue Date | Patentee |
|---|---|---|---|
| 4,554,694 | B1 | 1985 Nov. 26 | Tradigo and Tradigo |
| D498-915 | B1 | 2004 Nov. 30 | Achcar |
| 7,827,707 | B1 | 2010 Sep. 11 | Davis |
| 5,129,165 | B1 | 1992 Jul. 14 | Woodle |
| 5,791,069 | B1 | 1998 Aug. 11 | Oradesky |

U.S. Patent Application Publications

As of this writing, and to the best of my knowledge, no relevant prior art applications have been published.

Foreign Patent Application Publication

| Application No. | Cntry. Code | Int. Cl. | Filing Date | Applicant |
|---|---|---|---|---|
| 0614276.4 | GB | A43B 23/08 | 2006 Jun. 23 | Taylor |

Nonpatented Product Formerly for Sale Online

A V-shaped, rigid, plastic article with segments the user could break off to reduce the size of the article in case it was too large to fit into the toe box of a shoe was at one time sold online.

In recent years, pointed-toed women's footwear has become increasingly popular. In the early 1960's, women's shoes with pointed toes were also popular; however, the shoes were made so that the wearer's toes were crammed into the toe box of the shoe, which narrowed to a point. These shoes were designed to be fashionable, but they were painful to wear, and repeated wearing resulted in foot problems such as bunions, corns, and hammertoes.

Sine then, pointed toed shoes are made so that the pointed toe box of the shoe that is designed into the shoe as an aesthetic feature and begins where the tips of the toes (the distal part of the toes) reside within the toe box. These shoes accommodate the width of the toes, but unlike the shoes of decades ago, the fashionable pointed, toe box extends beyond the tips of the toes. A woman may purchase a pointed-toe shoe in her size, but there may be anywhere from one-half inch to one and one-half inches of shoe material that extends beyond the tip of her toes. This pointed toe box of the shoe provides the fashionable aspect to the shoe without crowding the toes as the pointed-toed shoes did in the past.

When any type of shoe is worn, it bends to the wearer's foot and eventually forms creases across the width of the shoe in the proximal toe area. These folds remain when the shoe is not being worn. The shoe no longer has the full, uniform shape it did when newly purchased. Because the point that extends beyond a wearer's toes in today's pointed-toed shoes does not contain any part of the foot to hold its shape when worn—the aesthetic pointed toe box is essentially "empty," the shoe bends at the place where the wearer's toes end and the pointed toe box begins. Eventually, and sometimes upon only a few wearings and depending on the thickness of a shoe's material, the aesthetic point of a shoe begins to flatten, crease, and sometimes bends upward. The pointed toe box that was supposed to provide a fashionable aspect to a shoe is now deformed.

Some women pay hundreds of dollars for one pair of pointed-toed shoes, only to have the pointed toe deform after having worn the shoes a few times. Conversely, women of limited financial means who have purchased relatively inexpensive pointed-toe shoes may stop wearing the shoes once the toe section has become deformed, which is not only disappointing to a woman, but she has essentially also wasted her hard-earned money on a pair of shoes.

Shoes made of natural materials such as leather stretch upon wearing. Many women's fashion shoes with the extended point are made of leather. While the fashionable pointed toe box bends and deforms upon wearing, the rest of the shoe stretches, especially across the width of the shoe where the proximal toes bend when a person walks. This stretching may cause the foot to slip downward into a shoe, which results in the heel slipping either partially or entirely out of the shoe upon walking. Manufacturers have developed shoe shapers to help stretch shoes while they are not being worn. They have also developed inserts made of foam to make shoes more comfortable while wearing and inserts that adhere to the inside heel portion of the shoe to prevent slippage. However, these shoe shapers and inserts do not address the problems of maintaining a pointed-toe shoe's fashionable aesthetic Both U.S. Pat. No. 4,554,694 to Tradigo A. and Tradigo F. (1985) and U.S. Pat. No. D498,915 to Achcar (2004) show shoe-shaping devices. These shapers fill the entire length of a shoe and are meant to be placed in the shoe while the shoe is not being worn. These shapers have an end member that abuts the inside heel surface of a shoe and a toe box member that fits into the toe box of the shoe and fills the space. Both of these shapers are fixed on a horizontal plane from the part of the shaper that abuts the inside heel part of the shoe and the part that fits into the toe box by rigid material. These shapers would best be suited to a shoe where the shoe insole is flat; that is, with a wide toe box and that has a heel height of not more than one-half inch. Women's pointed-toe shoes have heel heights beginning at less than one-half inch, with some shoes having heel heights of up to four inches or more. As the heel height of the shoe increases, the part of the shoe that supports the arch of the foot forms an angle from toe to heel, so a rigid shoe shaper would not fit into high-heeled shoes. The proximal member of these shoe inserts would also be too wide to fit into the narrower pointed-toe box of women's fashion shoes. Furthermore, these types of shoe shapers are devised to stretch out the folds and compressions that develop after the shoe is worn; they do not prevent the pointed part of the shoe from becoming bent, wrinkled, or from bending upward Davis, in U.S. Pat. No. 7,827,707 (2010), describes a memory foam shoe insert that can be placed in the "distal end of the shoe toe box and present a proximal toe-engaging face that substantially spans the cross-sectional dimensions of the toe box." Davis mentions that " . . . some women's high-heel shoes having sharply pointed toe box, such that the toes can experience an extreme amount of pressure." However, the "sharply pointed toe box" that Davis describes refers to shoes where the tips of the toes are crammed into a pointed toe box, such as those produced several decades ago and mentioned earlier. When wearing shoes where the point extends beyond the tips of the woman's toes, pressure on the toes does not occur because the width of the shoe accommodates the width of the toes. The pointed toe box is essentially "empty;" that is, the toes do not occupy this space. Davis' foam inserts are designed to "provide comfort to the shoe wearers," the toes specifically; they are not designed to maintain the fashionable shape of a pointed toe box.

At one time, a shoe insert was sold online that was shaped like an inverted "V," was made of rigid plastic, and had break-off segments to accommodate different sizes of pointed toe boxes. If a woman wears hosiery such as tights or nylons, the portion of the insert where the segment was broken off may snag or tear the hosiery. When the ends of the toes come in contact with this insert, the rigid material could feel hard and uncomfortable against the toes. Also, these inserts are made to be taken out of the shoe. My guess is that because these inserts were relatively expensive, one pair is meant to be removed from a first pair of shoes to be used in a second pair. However, the broken insert may only fit the pointed toe box of one particular pair of shoes that a woman owns and might not fit into shoes she already has in her closet or that she purchases in the future. Also, one cannot custom-cut these inserts to fit a particular pair of shoes; one must break off segments of predetermined length. Therefore, the user may never achieve the size of insert she needs that does not crowd but is large enough so that the insert maintains or restores the aesthetic shape of the pointed to box. As of this writing, I could no longer find these inserts online or any reference to them.

In a patent application published in the United Kingdom, No. 0614276.4 (2006), Taylor describes in the Abstract a compressible insert that "conforms to the contours of the user's foot . . . preferably has a tab . . . attached to allow the user to easily remove the insert from the footwear [and] . . . larger inserts may have a plastic internal core which is coated with closed cell foam to strengthen in the insert." Nowhere in the application does Taylor disclose how to make this insert except to state that "it will be primarily composed of compressible closed cell foam" and that "further investigation of the most suitable material is needed." Despite the fact that Taylor fails to describe a suitable material for the insert, and consequently cannot disclose how to manufacture such an insert or if it is even feasible or economical, the disadvantages of Taylor's insert, in relation to what is stated in her Abstract, are as follows:

a) An insert that is made of a material soft enough to "conform to the user's foot" would not be sufficiently strong enough to uphold the pointed shape of the toe box because it would compress as the user walks and when the top of the shoe presses down on the insert.
b) An insert that is made of a material soft enough to "conform to the user's foot" would not be sufficiently strong enough to uphold the pointed shape of the toe box because it would compress as the user walks and when the top of the shoe presses down on the insert.
c) Inserting a ribbon tab requires not only additional tooling (and thus increases cost on what should be a relatively inexpensive product), but inserts with curves (as opposed to angles, which can be cut from a prefabricated sheet of material) must be manufactured in molds where the material is injected and then cured. Therefore, "embed[ding]" the tab into the insert would require hand-placement of the ribbon into each cavity within the mold. Also, the mold would have to be tooled so that the portion that extends out from the core of the insert would have to have a place for the tab to rest while the material is injected into the core. Otherwise, the ribbon tabs would most likely become partially covered with the material being injected into the mold cavities. The tabs would look sloppily made even though the extensive tooling costs would substantially add to the price of the insert.
d) Adding to the cost and complication of Taylor's insert is the "plastic core." Adding a core would require a two molds with different sized cavities—a smaller cavity to manufacture the core, and a second mold with a larger cavity for this larger insert. The manufacturer would have to hand-place the manufactured hard core into a second mold with a larger cavity where the material that "conforms to the user's foot" is then injected or poured.
e) If a flowered pattern, though not necessary to the function of the insert, were to be applied to the outside surface of the insert, as Taylor depicts in FIG. 2, and the insert were made of a "compressible" material," then the pattern would have to be stamped onto each insert likely at a second manufacturing facility. Pattern-stamping is an entirely different process from mold manufacturing and injection molding.

Woodle, in U.S. Pat. No. 5,129,165 (1992), describes a silicone rubber custom toe cap for ballet pointe shoes that is custom-molded to a dancer's foot. When the dancer is dancing en pointe (on his or her toes), the toe cap provides a "stable weight bearing platform for the relatively shorter toes of a ballet dancer . . . " The purpose of the toe cap is to protect the toes and allow for a more stable base upon which to dance, and not to maintain the shape of the ballet shoe. Woodle teaches that the toe cap is made when a "putty-like substance, preferably a silicone rubbed based compound, is . . . applied directly to the toes to be supported . . . " Then, a plastic bag is placed over the foot; the dancer's foot is placed into the ballet shoe; the dancer stands en pointe, and the rubber compound is allowed to flow in between the toes and the ballet shoe platform. Therefore, Woodle's toe cap is a rubber device that fits over the toes and molds to them; it is meant to support the toes and not the ballet shoe itself. Also, the "soft putty like substance" that Woodle teaches be used to produce this toe cap would be too soft to maintain the pointed toe cavity of a shoe that extends beyond a wearer's toes.

In U.S. Pat. No. 5,791,069 (1998), Oradesky describes a pointed toe shoe construction that allows a woman to wear pointed-toe shoes without having her toes crammed into the pointed-toe cavity of the shoe. Oradeskly proposes manufacturing pointed-toe shoes slightly longer than usual for a given shoe size so that the toes fit within a wider toe box; the pointed toe cavity extends beyond the wearer's toes, and the toes are not crammed. However, with this construction, a "liner" is needed to keep the toes from sliding into this longer shoe and the pointed toe cavity. Oradesky's liner is more like a partition than a liner: "The toe line insert is placed between the sole and the upper in the toe section of the shoe" and is "permanently affixed to the shoe." Disadvantages exist with this liner and shoe construction. First, not all people's toes are the same length and size. Some people have a second toe that is longer than the big toe. This liner might cause the problem it proposes to prevent: that of the toes being crammed, except with Oradesky's liner, the toes would become crammed against the liner instead of being crammed into the pointed toe box. A woman would then need to buy a pair of shoes one-half to one size larger from what she usually wears. Because extra length is added to the shoe, but the shoe is "not larger in any other aspects," the wearer might trip on this extra length. As a result, she may not be able to purchase the shoes at all, so she is at a loss as is the retailer who loses the profit from a potential sale. Third, the addition of this liner would add to the cost of the shoe. Fourth, Oradesky states that the space between the liner and the tip of the shoe can be filled with materials such as cloth. Unless the cloth is highly compacted into the toe box, the additional length of the shoe will crease and become deformed. Also, this extra filler may add weight to this additional section of the shoe. Both the liner and these materials add to the cost of the shoe. Furthermore, because the liner and filler materials are permanently manufactured into the shoe, they cannot be removed, cut, or altered in any way to accommodate different toe lengths. If the toes abut the liner, they will be crammed within the shoe—the very problem that Oradesky is trying to overcome.

SUMMARY

In accordance with one embodiment, a one-piece shoe insert that is triangular in shape with a flat underside and curved topside, a flat or concave base and is made of a dense, non-malleable, resilient material that can be cut with scissors and returns to its original shape after being compressed.

ADVANTAGES

Accordingly, several advantages of one or more aspects are as follows: to provide a one-piece shoe shaping insert that is relatively inexpensive to manufacture, so that even women on limited budgets can extend the life and aesthetic of their pointed-toe shoes and purchase multiple pairs of inserts if desired; that is dense enough to maintain the shape of the shoe but is compressible so that it can be squeezed into the toe box of the shoe; can be trimmed with scissors to accommodate longer toes; that remains in place in the toe box of the shoe by friction and expansion of the material against the interior of the toe box, and that can be removed from the shoe by squeezing the toe box with one's hand or by inserting a blunt object such as a flat screwdriver under the shaper to dislodge it, thus not requiring tabs integral to the insert or other removal devices that add manufacturing steps and facilities, ultimately adding to the cost of the insert.

Other advantages of one or more aspects will be apparent from a consideration of the drawings and ensuing description.

DRAWINGS—FIGURES

Figure 3A:
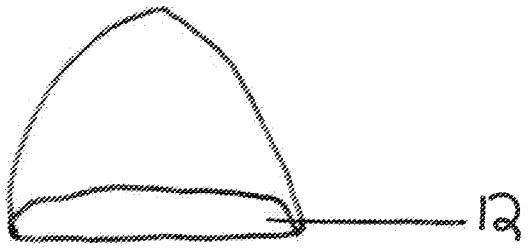
Figure 3B:
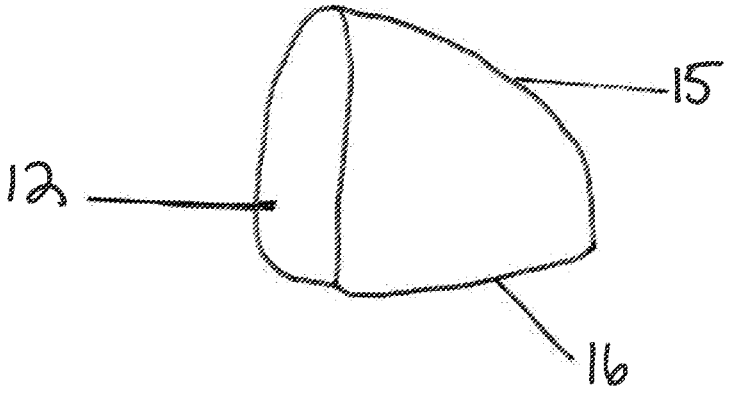

FIGS. 3*a* and 3*b* show a top and side view, respectively, of the insert where the base is straight in accordance with one embodiment.

Figure 4A:
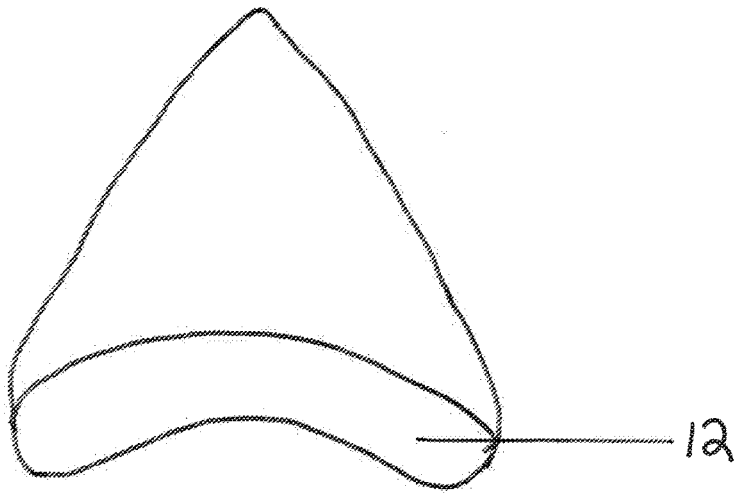
Figure 4B:
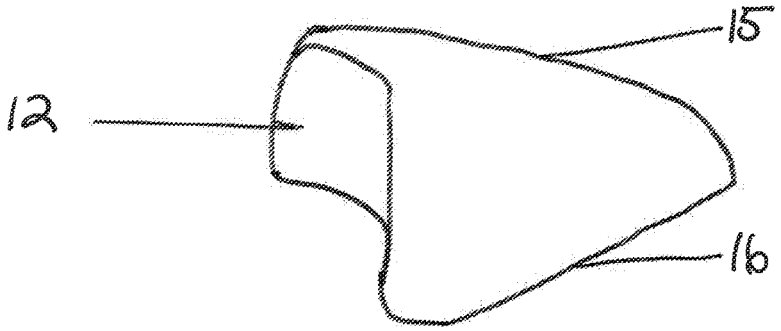

FIGS. 4*a* and 4*b* show a top and side view, respectively, of the insert where the base is concave in accordance with another embodiment.

DETAILED DESCRIPTION OF THE DRAWINGS

Figure 1:
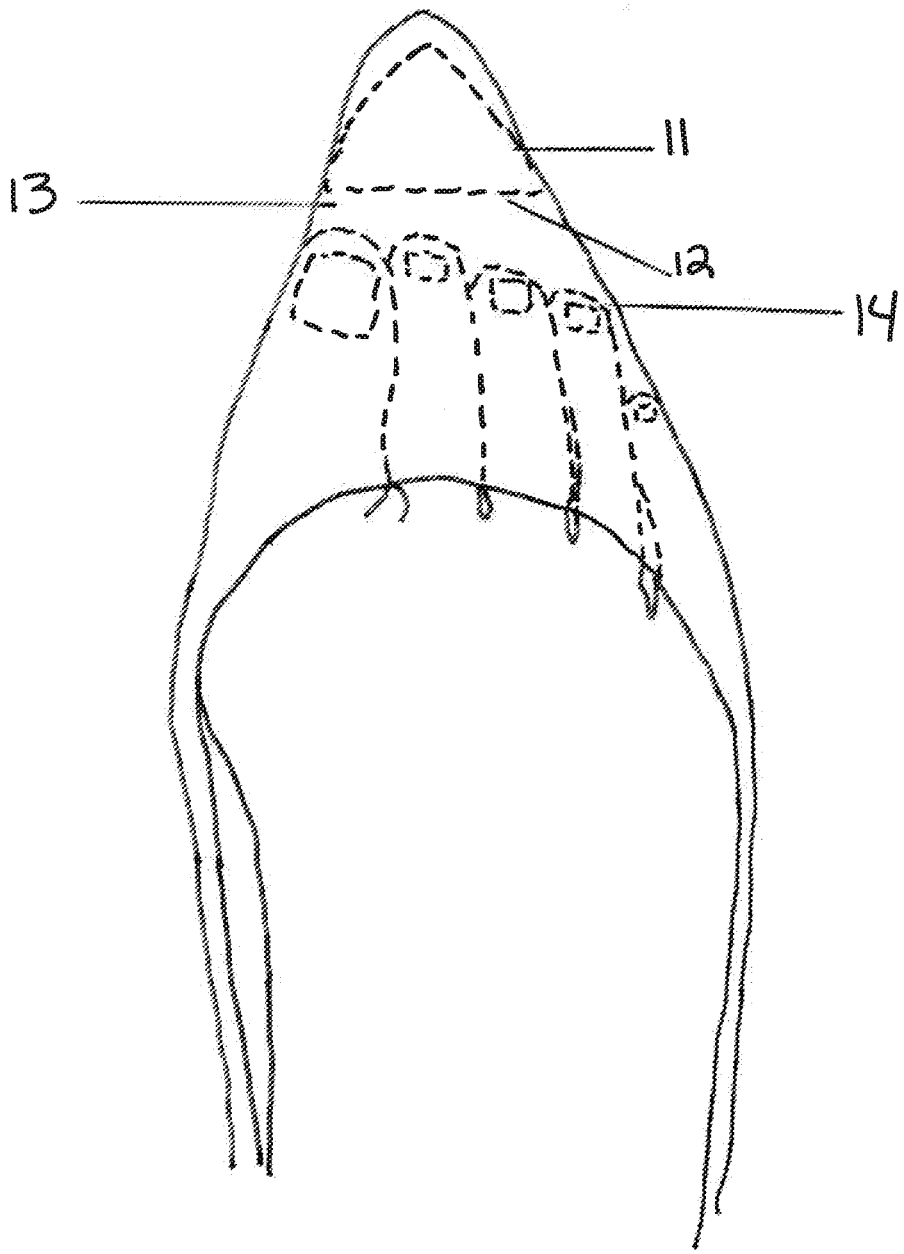
FIG. 1 is a top view perspective of a pointed-toe shoe with a one-piece shoe insert and the toes shown in phantom inside the toe box.

FIG. 1 illustrates one embodiment (top view of shoe with insert and toes shown in phantom). The insert (11) remains in place within the shoe due to friction and expansion of the material against the interior of toe box (13). The embodiment in this figure has a flat (straight) base (12). The insert (11) fills the toe box (13) cavity but is small enough so that it does not crowd the toes. If the distal part of the toes (14) do come into contact with the base of the insert (11), the insert can be trimmed with scissors.

Figure 2:
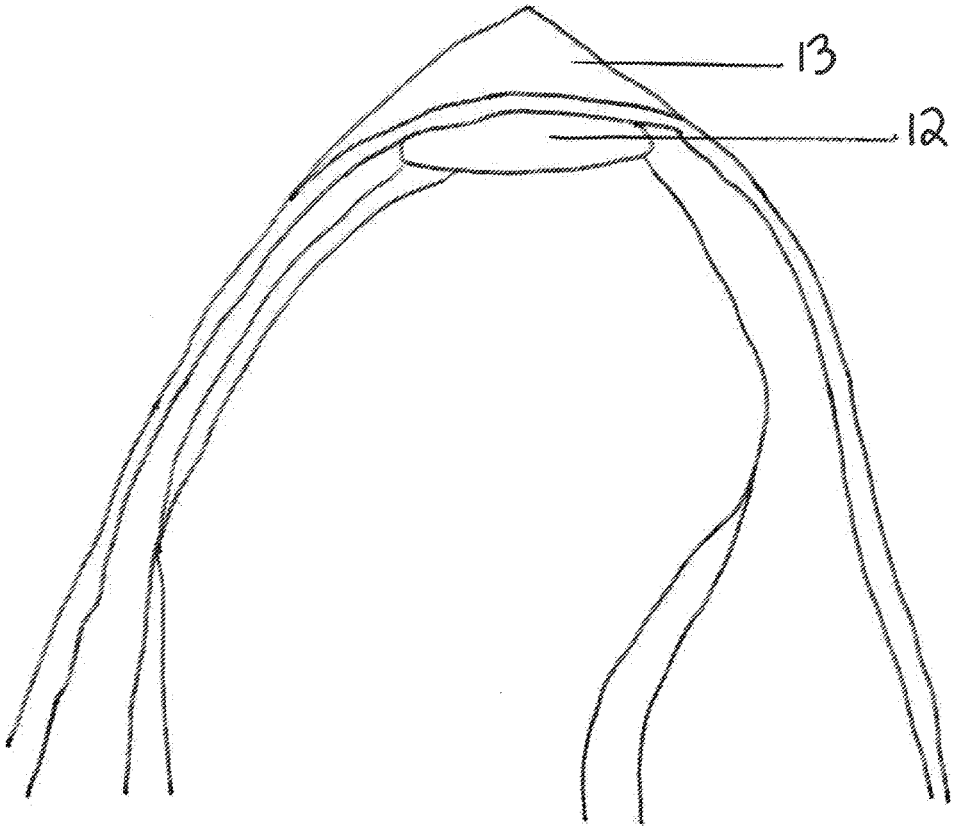
FIG. 2 is an interior perspective of a shoe that shows the base of the insert when an insert is in place in the toe box section of a shoe.

FIG. 2 is an interior perspective of the toe box (13) which shows the base of the insert (12) when the insert fills the toe box (13). The top of the insert (12) is slightly rounded where it comes into contact with the inside upper portion and sides of the toe box (13).

Operation—FIGS. 1 and 2

To place the insert into the toe box of a pointed toe shoe, one can choose either the left or right shoe to begin. Because the pointed toe box of a shoe extends beyond the toes, it is not designed or manufactured to fit the contours of either the right or left foot. The one-piece pointed toe shoe shape preserver and restorer is shaped to fit into this section of a pointed toe shoe, so it follows that the pair of inserts would be identical in shape and size.

The user takes in one hand a pointed toe shoe and holds the toe box section so that the underside of that portion of the shoe sits in the palm of the hand. One firmly grasps the toe box and squeezes it so the toe box opens up and the top of the shoe becomes convex. One then picks up an insert with the opposite hand, lightly holding it between the thumb and index finger. Holding the insert so that the flat underside of the insert that is to come into contact with the bottom interior of a shoe faces this part of a shoe, one directs the curved pointed end of the insert into the pointed end of the toe box. Because the insert is meant to stay in place within the toe box due to friction and the expansion of the resilient material of which it is made, the user pushes against the base of the inert; this action facilitates its moving up into the toe box as far as it can be pushed. One continues to squeeze the toe box open until the insert cannot be pushed up any further into the toe box. At this point, the user stops squeezing the toe box, and the insert is in place.

If a shoe has been previously worn, and the toe box had become deformed, the insert will now be exerting slight pressure outward, pushing the once deformed, flattened, or bent material of the shoe in the toe box area up and outward, restoring the full, rounded shape that the pointed toe box had upon purchase. If the leather or other material of which the shoe was worn so often that creases formed in the pointed to section, the line that creases form might remain after an insert is wedged into the shoe, but the section where the crease is will no longer be bent; it will be full and more aesthetically pleasing.

The insert will remain in the shoe until it is manually removed. To remove the insert, one grasps the toe box of the shoe as one did when inserting it. Simultaneously squeezing the toe box to open it up and shaking the shoe on a vertical plane might be enough to shake the insert out of the toe box. If the insert remains inside of the toe box, one can continue to squeeze the toe box open and either remove the insert by wedging one's index finger underneath the insert at its base and pulling it out. The user can also use a small, blunt instrument such as a flat edge screwdriver to perform this same action. A used pair of inserts can be used in another pair of shoes.

FIGS. 3*a* and 3*b* show one embodiment of the insert (11) from two perspectives: FIG. 3*a* shows a top view of the insert (11), and FIG. 3*b* shows a side view of the insert (11). In this embodiment, the widest end of the insert (12) is straight across. The topside of the insert (15), FIG. 3*b*, is a rounded triangular shape and gradually increases in height from the slightly rounded tip to the top of the base (12) where it comes into contact with the curved interior of the toe box. The underside of the insert (16), FIG. 3*b*, is flat. The length of the topside from tip to base (12) measures roughly 2.25 cm. The width of the underside of the insert (11) at its widest part measures roughly 3.00 cm. The height of the insert at its base (12) the measures roughly 1.75 cm.

These measurements allow the insert to squeeze far enough into a the toe box so that it remains in place due to friction and to be far enough up into the toe box so that the user's toes are not crammed against the insert (11). That said, the measurements of the base (12) could be slightly smaller so that no trimming of the insert (11) is needed. Likewise, the inserts could be made slightly longer and wider in order to accommodate shoes with larger pointed toe boxes.

In one embodiment, the insert is made of open cell polyurethane foam. Compared to other foams, open cell polyurethane foam is resilient, energy absorbing, and high strength. Polyurethane foam is an elastomer. Elastomers are elastic, which means they can be stretched or compressed but will return to their original shape.

The polyurethane foam base material is an off-white color; therefore, it can be mixed with pigments or dyes so that the inserts are made in aesthetically pleasing colors when sold in commerce. The foam base material and pigment are mixed in a Reaction Injection Molding (RIM) machine. Then the mixture is injected into the cavities of a solid mold wherein each cavity forms the shape of the insert (11). The polyurethane foam is allowed to cure (harden). The solid mold would then be dismantled, and the inserts either fall out of the mold or are pulled out of the mold cavities if necessary. The polyurethane foam forms a thin skin as it is curing, which gives the insert a nice, aesthetic sheen. Also, the insert is smooth and does not visibly contain holes as some foams do. Furthermore, the insert is one-piece, and the material is homogenous throughout. At this point, the insert (11) is immediately usable and ready for sale.

The cured polyurethane foam is dense enough so that the insert (11) can be compressed within the toe box (13) of a shoe and remain in place due to friction and the expansion of the material against the interior of the toe box. Therefore, adhesives on any surface of the insert are not required. Also, the density of the material allows the insert to withhold the full shape that the toe box has when a shoe is new; likewise, it can restore the shape of already worn and deformed shoes. If the tips of the toes come into contact with the insert, the insert can be trimmed with scissors. The cured polyurethane foam, using a Shore C scale, has a durometer of 25-30 C to roughly 35-40 C or slightly less than 45-50 C. An insert with the durometer measurement of 45-50 C or higher may not be suitable because if the toes do come into contact with it while the user is walking, it does not yield and may cram the toes. That said, an insert (11) with a durometer of 45-50 C can be cut with scissors.

Polyurethane foam with Shore durometer readings from 25-30 C to roughly 35-40 C or slightly less than 45-50 C is not malleable, nor does it permanently take on the shape of whatever it is compressed against. When removed from a shoe, the one-piece insert (11) would have the same shape it had upon purchase, although it might look "worn" or be marked with color from leather dye. The ability of the insert (11) to perform its function will not have been impaired. Thus, a pair of used inserts could be used in another pair of shoes.

Another material from which the one-piece insert (11) can be made is a neoprene blend closed cell foam. A neoprene blend with a durometer of Shore C of roughly 15-20 C would be resilient, non-malleable, and dense enough to withhold the shape of the pointed toe box for the life of a pair of shoes. Likewise, one-piece insert made of a silicone gel with a Shore 00 durometer of 30 could be cut with scissors, yield to the toes if contact between the insert and the toes occurs, and would remain in place within a pointed toe box when the measurements are such that the insert is at least as large as the toe box it is going to support.

It is understood that other materials that provide adequate resilience, density, ability to be trimmed with scissors, and supportive function can also be used such as such as foam rubber, rubber, and soft plastics.

FIGS. 4*a* and 4*b* illustrate another embodiment where the base (12) of the insert (11) is concave. FIG. 4*a* is a top view of the one-piece insert (11), and FIG. 4*b* is an angled side view of the insert (11). Both figures show the concave base. A concave base (12) would provide slightly more space between the tips of the toes and the base (12) of the insert than would an insert with a flat base (FIG. 3*a*). However, this concave shape at the base (12) would not affect the supportive function of the insert because the loss of material is not significant. Also, because more room for the toes exists within the toe box, there would probably be no need to trim the insert with scissors.

FIG. 4*b* shows the increase in height of the topside (15) from tip to base (12). FIG. 4*b* also shows that the underside (16) is flat.

Advantages

From the description above, a number of advantages of the embodiments of my one-piece shoe insert become evident:

a) The rough measurements enable the insert to be held in place within a toe box of a pointed toe shoe by friction.
b) The density and resiliency of the material allow the one-piece insert to remain in place within a toe box due to compression of the material against the interior, curved portion of a pointed toe box.
c) Because the insert is held in place by friction and compression against the interior of the distal end of the toe box, it does not require adhesives to hold it in place.
d) The insert can be removed by squeezing the toe box or by inserting a blunt instrument or one's index finger under the base (12). Therefore, a tab or similar addition to the insert that the user would pull on to remove the insert does not need to be manufactured or designed into the insert.
e) The material is resilient enough so that even when it is housed within a toe box and compressed upon when the user walks, upon removal from a shoe, the insert springs back into its original dimensions and can be reused.
f) The insert is dense enough so that it preserves the aesthetic shape a pointed toe box had upon purchase without the incorporation of reinforcing materials to ensure that it performs its function.
g) The insert is made in using one mold, which keeps the cost of what should be an inexpensive purchase low.

CONCLUSION, RAMIFICATIONS, AND SCOPE

Accordingly, the reader will see that my one-piece shoe insert of several embodiments is easy to insert into and remove from a shoe, does not crowd the toes, can remain in a shoe for its life and continue to fulfill its function, and if removed from one pair of shoes, can be used in another pair.

Furthermore, my one-piece shoe insert has additional advantages:

- The material is resilient enough so that it springs back into its original shape upon removal from a shoe even if the insert has been housed within a toe box and been compressed upon when a user walks;
- The insert is dense enough to withhold and support the aesthetic shape a toe box had upon purchase, or it can fill out a deformed toe box on an already worn shoe;
- The material can be mixed with pigments to make the one-piece insert aesthetically pleasing;
- The insert can be trimmed with scissors;
- The insert is made uniformly from one material and from one mold, thus reducing manufacturing costs;
- The insert remains in place within a shoe due to friction and expansion of the material against interior of the toe box and without adhesives.

Although the description above contains several specificities, these should not be construed as limiting the scope of the embodiments. For example, the insert can have other shapes, such as rounded to fit into round-toed shoes, or square or rectangular to fit into square-toed shoes.

Thus the scope of the embodiments should be determined by the appended claims and their legal equivalents, rather than by the examples given.

I claim:

1. A one-piece shoe insert comprising: a pre-sized and substantially triangular body formed of foam, said body having a convex topside, an underside, and a base which is vertical to said underside, said underside having a width of about 3.00 cm, said base having a height of about 1.75 cm, said convex topside having a length of about 2.25 cm, the body formed to fit within the distal toe region of a pointed-toe shoe.

2. The one-piece shoe insert of claim 1, said foam having a durometer. of between 25 and 50 Shore C.

3. The one-piece shoe insert of claim 2, said foam having a durometer of 37 Shore C.

4. The one-piece shoe insert of claim 1, said convex topside having a rounded tip.

5. The one-piece shoe insert of claim 2, said body preserves the shape of said distal toe region of a pointed-toe shoe.

6. The one-piece shoe insert of claim 2, said body restores the shape of said distal toe region of a pointed-toe shoe.

* * * * *